US009654854B2

(12) United States Patent
Darlington et al.

(10) Patent No.: US 9,654,854 B2
(45) Date of Patent: May 16, 2017

(54) IN-EAR DEVICE INCORPORATING ACTIVE NOISE REDUCTION

(76) Inventors: Paul Darlington, Manchester (GB); Yacine Azmi, San Francisco, CA (US); Mickael Bernard Andre Lefebvre, Auckland (NZ); Oliver Michael James Hewitt, Auckland (NZ)

( * ) Notice: Subject to any disclaimer, the term of this patent is extended or adjusted under 35 U.S.C. 154(b) by 192 days.

(21) Appl. No.: 13/486,085

(22) Filed: Jun. 1, 2012

(65) Prior Publication Data

US 2013/0058493 A1 Mar. 7, 2013

Related U.S. Application Data

(60) Provisional application No. 61/491,983, filed on Jun. 1, 2011.

(51) Int. Cl.

| | |
|---|---|
| ***H04R 1/10*** | (2006.01) |
| ***H04R 1/08*** | (2006.01) |
| *H04R 1/28* | (2006.01) |

(52) U.S. Cl.

CPC ..... *H04R 1/083* (2013.01); *H04R 1/2838* (2013.01); *H04R 2460/01* (2013.01)

(58) Field of Classification Search

CPC ..... H04R 1/1083; H04R 2460/01; H04R 2225/49; H04R 2225/43; H04R 1/1016; H04R 1/2838; H04R 1/28; H04R 1/2803; H04R 1/2846; H04R 1/2869; H04R 1/2873; H04R 1/2876; H04R 1/2884; H04R 1/2888

USPC ..... 381/71.6, 71.7, 328, 322, 317, 318, 372

See application file for complete search history.

(56) References Cited

U.S. PATENT DOCUMENTS

| | | | | |
|---|---|---|---|---|
| 1,368,307 A | | 2/1921 | Waldron | |
| 1,498,727 A | | 6/1924 | Haskel | |
| 1,514,152 A | | 11/1924 | Gemsback | |
| 1,586,140 A | | 5/1926 | Bonnette | |
| 1,807,225 A | | 5/1931 | Pack | |
| 2,346,395 A | | 4/1944 | Rettinger | |
| 2,379,891 A | | 7/1945 | Eckardt | |
| 2,427,844 A | | 9/1947 | Eklov | |
| 2,490,466 A | | 12/1949 | Olson | |
| 2,493,734 A | * | 1/1950 | Pearson | H04R 11/06 381/328 |
| 2,603,724 A | | 7/1952 | Kettler | |

(Continued)

FOREIGN PATENT DOCUMENTS

| | | |
|---|---|---|
| CN | 1101203 | 4/1995 |
| CN | 1213626 | 4/1999 |

(Continued)

OTHER PUBLICATIONS

D'Appolito Testing Loudspeakers, Audio Amateur Publications, 1998, Chapter 2, Driver Testing, pp. 9-36.

(Continued)

*Primary Examiner* — Vivian Chin
*Assistant Examiner* — Jason R Kurr
(74) *Attorney, Agent, or Firm* — Jackson Walker L.L.P.

(57) ABSTRACT

An in-ear device incorporating active noise reduction has a housing adapted for location in or adjacent to an auditory canal. The housing contains a driver and an acoustic path is provided from the driver to an outlet of the device. A microphone and an acoustic impedance are provided in the acoustic path. The impedance increases the stability of the device.

19 Claims, 12 Drawing Sheets

(56) References Cited

U.S. PATENT DOCUMENTS

| | | | | |
|---|---|---|---|---|
| 2,622,159 | A | 12/1952 | Herman | |
| 2,714,134 | A | 7/1955 | Touger | |
| 2,761,912 | A | 9/1956 | Touger | |
| 2,775,309 | A | 12/1956 | Villchur | |
| 2,848,560 | A | 8/1958 | Wiegand | |
| 2,972,018 | A | 2/1961 | Hawley et al. | |
| 2,989,598 | A | 6/1961 | Touger | |
| 3,073,411 | A | 1/1963 | Bleazey | |
| 3,112,005 | A | 11/1963 | Shaw | |
| RE26,030 | E | 5/1966 | Marchand | |
| 3,367,040 | A | 2/1968 | Vani | |
| 3,403,235 | A | 9/1968 | Bishop | |
| 3,532,837 | A | 10/1970 | Dyar | |
| 3,602,329 | A | 8/1971 | Bauer et al. | |
| 3,644,939 | A | 2/1972 | Beguin | |
| 3,727,004 | A | 4/1973 | Bose | |
| 3,766,332 | A | 10/1973 | Carlson | |
| 3,927,262 | A | 12/1975 | Goeckel | |
| 3,997,739 | A | 12/1976 | Kishikawa | |
| 4,005,267 | A | 1/1977 | Gorike | |
| 4,005,278 | A | 1/1977 | Gorike | |
| 4,006,318 | A | 2/1977 | Sebesta | |
| 4,027,117 | A | 5/1977 | Nakamura | |
| 4,041,256 | A | 8/1977 | Ohta | |
| 4,058,688 | A | 11/1977 | Nishimura | |
| 4,156,118 | A | 5/1979 | Hargrave | |
| 4,158,753 | A | 6/1979 | Gorike | |
| 4,211,898 | A | 7/1980 | Atoji et al. | |
| 4,297,537 | A | 10/1981 | Babb | |
| 4,338,489 | A | 7/1982 | Gorike | |
| 4,347,405 | A | 8/1982 | Davis | |
| 4,399,334 | A | 8/1983 | Kakiuchi | |
| 4,403,120 | A | 9/1983 | Yoshimi | |
| 4,418,248 | A | 11/1983 | Mathis | |
| 4,441,576 | A | 4/1984 | Allen | |
| 4,455,675 | A | 6/1984 | Bose | |
| 4,494,074 | A | 1/1985 | Bose | |
| 4,527,282 | A | 7/1985 | Chaplin et al. | |
| 4,528,689 | A | 7/1985 | Katz | |
| 4,529,058 | A | 7/1985 | Emery | |
| 4,572,324 | A | 2/1986 | Fidi et al. | |
| 4,581,496 | A | 4/1986 | Sweany | |
| 4,592,366 | A | 6/1986 | Sainomoto | |
| 4,644,581 | A | 2/1987 | Sapiejewski | |
| 4,646,872 | A | 3/1987 | Kamon et al. | |
| 4,669,129 | A | 6/1987 | Chance | |
| 4,670,733 | A | 6/1987 | Bell | |
| 4,742,887 | A | 5/1988 | Yamagishi | |
| 4,809,811 | A | 3/1989 | Gorike | |
| 4,847,908 | A | 7/1989 | Kieuwendijk | |
| 4,852,177 | A | 7/1989 | Ambrose | |
| 4,893,695 | A | 1/1990 | Tamura et al. | |
| 4,905,322 | A | 3/1990 | Aileo et al. | |
| 4,922,542 | A | 5/1990 | Sapiejewski | |
| 4,949,806 | A | 8/1990 | Hofer | |
| 4,985,925 | A * | 1/1991 | Langberg et al. | 381/71.6 |
| 4,989,271 | A | 2/1991 | Sapiejewski | |
| 5,001,763 | A | 3/1991 | Moseley | |
| 5,020,163 | A | 6/1991 | Aileo et al. | |
| 5,117,461 | A | 5/1992 | Moseley | |
| 5,134,659 | A | 7/1992 | Moseley | |
| 5,181,252 | A | 1/1993 | Sapiejewski | |
| 5,182,774 | A | 1/1993 | Bourk | |
| 5,208,868 | A | 5/1993 | Sapiejewski | |
| 5,267,321 | A | 11/1993 | Langberg | |
| 5,305,387 | A | 4/1994 | Sapiejewski | |
| 5,343,523 | A | 8/1994 | Bartlett et al. | |
| 5,497,426 | A | 3/1996 | Jay | |
| 5,504,281 | A | 4/1996 | Whitney | |
| 5,652,799 | A | 7/1997 | Ross et al. | |
| 5,675,658 | A | 10/1997 | Brittain | |
| 5,740,257 | A | 4/1998 | Marcus | |
| 5,913,178 | A | 6/1999 | Olsson | |
| 5,937,070 | A | 8/1999 | Todter et al. | |
| 5,970,160 | A | 10/1999 | Nilsson et al. | |
| 6,061,456 | A | 5/2000 | Andrea et al. | |
| 6,163,615 | A | 12/2000 | Callahan | |
| 6,278,786 | B1 | 8/2001 | McIntosh | |
| 6,597,792 | B1 | 7/2003 | Sapiejewski et al. | |
| 6,831,984 | B2 | 12/2004 | Sapiejewski | |
| 7,103,188 | B1 | 9/2006 | Jones | |
| 7,248,705 | B1 | 7/2007 | Mishan | |
| 8,472,637 | B2 * | 6/2013 | Carreras et al. | 381/71.6 |
| 8,532,310 | B2 * | 9/2013 | Gauger et al. | 381/71.6 |
| 8,571,227 | B2 * | 10/2013 | Donaldson et al. | 381/71.6 |
| 8,666,085 | B2 * | 3/2014 | Donaldson et al. | 381/71.6 |
| 2002/0015501 | A1 | 2/2002 | Sapiejewski | |
| 2005/0002541 | A1 * | 1/2005 | Killion et al. | 381/353 |
| 2008/0165981 | A1 * | 7/2008 | Wurtz | 381/71.6 |
| 2010/0329475 | A1 * | 12/2010 | Killion et al. | 381/72 |
| 2011/0064238 | A1 * | 3/2011 | Haas | 381/71.6 |

FOREIGN PATENT DOCUMENTS

| | | | |
|---|---|---|---|
| EP | 0195641 | B1 | 9/1986 |
| EP | 0582404 | | 2/1994 |
| EP | 0582404 | A3 | 2/1994 |
| EP | 0414479 | | 9/1995 |
| EP | 0688143 | | 12/1995 |
| EP | 0873040 | | 10/1998 |
| EP | 0688143 | B1 | 8/2001 |
| GB | 1379372 | | 1/1975 |
| GB | 2000941 | | 1/1979 |
| GB | 2168220 | A | 6/1986 |
| GB | 2172470 | A | 9/1986 |
| GB | 2187361 | A | 9/1987 |
| GB | 2188210 | A | 9/1987 |
| GB | 2234882 | | 2/1991 |
| GB | 2234882 | A | 2/1991 |
| JP | 04227396 | A | 8/1992 |
| WO | WO91/13429 | | 9/1991 |
| WO | WO 95/00946 | | 1/1995 |
| WO | WO 95/08907 | | 3/1995 |
| WO | WO 98/41974 | | 9/1998 |

OTHER PUBLICATIONS

Betanek, Noise and Vibration Control, Chapter 10, pp. 245-269.

John Borwick, Loudspeaker and Headphone Handbook (1st Ed., Butter & Co., 1988) complete text including references cited therein.

Small, Richard H., "Closed-Box Loudspeaker Systems", Part 1: Analysis, Journal of the Audio Engineering Society, 1972, pp. 271-282.

E.A.G. Shaw & G.J. Thiessen, Acoustics of Circumural Earphones, 34 The Journal of the Acoustical Society of America, No. 9, Sep. 1962.

Alfred DiMattia, "A Practical Ear Enclosure With Selectively Coupled Volume", AES Paper No. 460, AES Convention 31 (Oct. 1966), pp. 1-12.

Alfred DiMattia, "A Practical Ear EnclosureWith Selectively Coupled Volume", vol. 15 The Jounal of the Acoustical Society of.America, No. 3 (Jul. 1967), pp. 295-298.

Naraji Sakamoto, "Linear-Drive Headphones with Eardrum Response", AES Paper 1341, AES Convention 60 (May 1978), pp. 1-32.

Carl Poldy, "The Electrical Equivalent Circuit of Porous Complaint Membranes and Related Systems", AES Paper 1957 (D2), AES Convention 73 (Mar. 1983), pp. 1-15.

Ver, et al., "Sound-Absorbing Materials and Sound Absorbers", Noise and Vibration Control Engineering (John Wiley & Sons, Inc.2006), pp. 215-277.

Borwick, Loudspeaker and Headphone Handbook, Third Edition, Focal Press, Section 14.2.7 and 14.2.8.

Borwick, Loudspeaker and Headphone Handbook Third Edition, Focal Press, Section 14.2.3 and Fig. 14.8 and p. 605.

Beranek, et al., Noise and Vibration Control Engineering, Second Edition (John Wiley & Sons, Inc. 2006) p. 216, 231-232, 235-239.

Handbook for Sound Engineers, The New Audio Cyclopedia, Second Edition (Macmillan Computer Publishing, Copyright 1987 and 1991), p. 119.

(56) References Cited

OTHER PUBLICATIONS

Small, Richard H., "Direct-Radiator Loudspeaker System Analysis", IEEE Transactions on vol. 19, issue 4, Dec. 1971, pp. 269-281.
D'Appolito, "Low-Frequency System Electrical Impedance Tests," Testing Loudspeakers, Chapter 3, pp. 37-49.
Allan D. Pierce, Acoustics (excerpt), Acoustical Society of America through the American Institute of Physics, pp. 324-328.
Peter Lert, "Triumph of the Voyager," Air Progress vol. 49, No. 3, Mar. 1987, pp. 6-12 and 75-77.
"Headset cancels noise with noise," Show Daily, Jun. 15, 1987, p. 32.
E.H. Berger, "Using the NRR to Estimate the Real World Performance of Hearing Protection," Sound and Vibration, Jan. 1983, pp. 12-18.
Alice H. Suter, "Noise Wars," Technology Review, Nov./Dec. 1989, pp. 42-49.
George F. Kuhn, "The Pressure Transformation from a Diffuse Sound Field to the External Ear and . . . ," J. Acoust. Soc. Am., vol. 65, No. 4, Apr. 1979, pp. 991-100.
Terrell, et al., "Predicting Noise Reduction from Absorptive Treatments . . . ," American Industrial Hygiene Association Journal, vol. 44 Nov. 1983, pp. 809-813.
Jazef J. Zwislocki, "Sound Analysis in the Ear: A History of Discoveries," American Scientist, vol. 69, Mar.-Apr. 1981, pp. 184-192.
Don Denton, "Program Converts Test Data into Reliability Numbers," Electronic Design, Aug. 19, 1982, pp. 157-164.
Amar G. Bose, "Sound Recording and Reproduction . . . " Technology Review, vol. 75, No. 7, Jun. 1973, and No. 8, Jul./Aug. 1973 by MIT, Cambridge, MA.
John Free, "Noise Zapper," Popular Science, Jan. 1987, pp. 76-77 and 96.
Jack Norris, "Voyager, The World Flight, The Official Log, Flight Analysis and Narrative Explanation," Northridge, California, ISBN 09620239-0-6 (1987).
"Bose Acoustic Noise Cancelling Headsets to be Tested on Voyager Flight," Bose Press Release, Framingham, MA.
"Voyager Pilots Avoid Hearing Loss on Historic Flight, Bose Corporation's Noise-Cancelling Headsets Were 'Mission Critical,'" Bose News Release, Framingham, MA.
William D. Marbach, "Up, Up and Around," Newsweek, Dec. 29, 1986, pp. 34-44.
Marc E. Cook, "The Art of Noise," AOPA Pilot, Dec. 1989, pp. 65-69.
Phil Todd, "Principles of Magnetic Component Design," Powercon10 Professional Advancement Seminar, Power Innovations, Mar. 21, 1983, San Diego, California. pp. 1-35.
Capt. Stephen P. Shelton, "Active Noise Reduction (ANR)," Article (publication information unknown).
McKinley, et al., "Estimated Reductions in Noise-Induced Hearing Loss by Application of ANR Headsets," Scientific Basis of Noise-Induced Hearing Loss, Thieme, Chapter 28.
"Noise-Cancelling Headsets Featured at Telex Booth," NBAA Convention News, New Orleans, LA, Sep. 30, 1987, pp. 85-86.
Telex Communications, Inc. Aviation Products and Price Information Sheet, Effective Date Nov. 15, 1986.
"Anti-Lawaai Koptelefoon Van Sony" Article (publication information unknown).
"MDR-NC20 Service Manual," Noise Canceling Stereo Headphones Sony.
"MDR-NC10 Service Manual," Noise Canceling Stereo Headphones Sony.
"Presenting Sennheiser Electronic," Sennheiser Chronicle, Sennheiser Electronic, D-3002 Wedemark.
"Aearo Peltor Stratospher," AOPA Pilot, Jul. 1998, p. 114.
"Active Noise Reduction for use in Aircraft" Helmets Limited, Apr. 1990.
"Creative Unveils Aurvana X-Fi Noise-Canceling Headphones," Wireless News, Sep. 24, 2007 M2 Communications Ltd.
David Clark Company, Inc. Noise Attenuating Aviation Headsets and Accessories Product Information Sheet, 8 pages.
David Pogue, "Flying? Sit Back and Relax—And Zone Out for Less; Competing with Noise-Canceling Bose Headgear.(Finance)," International Herald Tribune, Jun. 14, 2007: 1-2.
Audio-Technica 900 Series Stereo Headphones Product Information Sheet, 2 pages.
Elliott H. Berger, "Single Number Measures of Hearing Protector Noise Reduction," E-A-R LOG2 (1996).
Elliott H. Berger, "Preferred Methods for Measuring Hearing Protector Attenuation," The 2005 Congress and Exposition on Noise Control Engineering, Aug. 7-10, 2005, Brazil.
Gauger, et al., "Voyager Pilots Avoid Hearing Loss on Historic Flight," S)V Observer, Bose Corporation, Framingham, MA.
Samuel Gilman, "Some Factors Affecting the Performance of Airline Entertainment Headsets," Journal of Audio Engineering Society, vol. 31, No. 12, Dec. 1983 pp. 914-920.
Don E. Bray, "Turbulent-Boundary-Layer Noise in the Interior of Aircraft Operating . . . ," Journal of Acoustical Society of America, vol. 60, No. 5, Nov. 1976: 1223-1225.
"Uniroyal Expanded Products Technical Bulletin Data," Uniroyal, Inc., Mishawaka, Indiana, Jul. 1982.
"More ANR from Bose, LightSPEED and DRE," The Aviation Consumer, Sep. 1998, p. 14.
"The Bose Acoustic Noise Cancelling Headset System," Bose Corporation, Framingham, MA, coypright 1987 Bose Corporation.
Dick Weeghman, "Headset Survey Results," The Aviation Consumer. Greenwich, CT, Aug. 1, 1991.
Fred Mackerodt, "Aviation Sounds of Silence," Popular Mechanics, vol. 167, No. 3, Mar. 1990.
Michael Alexander, "Bose Corp. Cuts Niche in Specialty Audio Market," The Boston Globe, Boston MA, Nov. 20, 1987.
Kenneth Korane, "Thermoplastic polyurethane extends headset life," News Off the Wire, Jul. 8, 1999.
David Clark Noise Attenuating Headsets Product Information, 11 pages, copyrighted 1989 David Clark Company.
K. Takagi, et al., "Prediction of Noise-Induced Temporary Threshold Shift," Journal of Sound and Vibration, Academic Press Limited (1988), pp. 513-519.
Kreul, et al., "Factors Affecting Speech Discrimination Test Difficulty," Stanford Research Institute, Menlo Park, California (7 pages).
Juergan Schroeter, "The Use of Acoustical Test Fixtures for the Measurement of Hearing . . . Part I . . . " J. Acoust. Soc. Am., Apr. 1986, vol. 79, No. 4, pp. 1065-1081.
Juergan Schroeter et al., "The Use of Acoustical Test Fixtures for the Measurement of Hearing . . . Part II . . . " J. Acoust. Soc. Am., Aug. 1986, vol. 80, No. 2, pp. 505-527.
E.H. Berger, "Method of Measuring the Attenuation of Hearing Protection Devices," J. Acoust. Soc. Am., Jun. 1986, vol. 79, No. 6, pp. 1655-1687.
Berger, et al., "Development of a New Standard Laboratory Protocol . . . Part III . . . " J. Acoust. Soc. Am., Feb. 1998, vol. 103, No. 2, pp. 665-672.
Berger, et al., "Influence of Physiological Noise and the Occlusion Effect . . . " J. Acoust. Soc. Am. Jul. 1983, vol. 74, No. 1, pp. 81-94.
Karl D. Kryter, "Methods for the Calculation and Use of the Articulation Index," J. Acoust. Soc. Am., Nov. 1962, vol. 34, No. 11, pp. 1689-1697.
Casali, et al., "Communications Headset Augmentation Via Active Noise Cancellation . . . " Proceedings of the Human Factors and Ergonomics Society 37th Annual Meeting—1993: 554-58.
"American National Standard Methods for the Calculation of the Articulation Index" American National Standards Institute, Inc., ANSI S3.5-1969: 6-24.
Stephen Elliott, "Down with Noise," IEEE Spectrum Jun. 1999, pp. 54-61.
Larry J. Eriksson, "A Brief Social History of Active Sound Control," Sound and Vibration, Jul. 1999, pp. 14-17.
Vaudrey, et al., "A Comparison of ANR Headset Performance for Loopshaping . . . " Presentation Brochure, Session 3aSP, 136th Meeting—Acoustical Society of America, Oct. 1998.

(56) References Cited

OTHER PUBLICATIONS

E. Zwicker, et al., "Critical Band Width in Loudness Summation," J. Acoust. Soc. Am., May 1957, vol. 29, No. 5, pp. 548-557.
E. Zwicker, "Subdivision of the Audible Frequency Range into Critical Bands" J. Acoust. Soc. Am., Feb. 1961, vol. 33, No. 2, p. 248.
"Noise Canceling Headset System Undergoes Developmental Tests," Aviation Week & Space Technology, Nov. 24, 1986.
John Makhoul, "Linear Prediction: A Tutorial Review," Proceedings of the IEEE, vol. 63, No. 4, Apr. 1975, pp. 561-580.

* cited by examiner

IN-EAR DEVICE INCORPORATING ACTIVE NOISE REDUCTION

This is a utility application that claims the benefit of and priority from U.S. Provisional Patent Application Ser. No. 61/491,983, filed Jun. 1, 2011.

FIELD OF THE INVENTION

This invention relates to in-ear devices incorporating active noise reduction. Such devices include but are not limited to earphones, "in-ear monitors", hearing aids and similar assisted listening devices. Moreover, the term "in-ear" includes devices that may be partially located in the human auditory canal.

BACKGROUND

The active noise reduction functionality relevant to the present invention is realized using "feedback" or hybrid (a combination of feedback and feed-forward) control architectures, in which a or a plurality of sensors which include but are not limited to a microphone is located inboard (i.e. closer to the wearer's ear) of the "receiver" (miniature loudspeaker or driver) in the device. The output of the microphone is used to provide the observation required for feedback (or equivalent) control of the pressure in the ear. Those skilled in the art will understand that systems using pure "feed-forward" controllers do not require the presence of such an inboard microphone.

The in-ear device typically has a housing in which the driver and microphone are located, and which provides an acoustic path from the driver to the outlet of the in-ear device. The outlet is in use located in the ear canal, so that the acoustic signal from the outlet can be delivered to the tympanic membrane (also known as the ear drum).

Positioning of a sensing microphone inboard of the driver requires the microphone is located in the acoustic path between the driver and the outlet. Thus the sound generated by the driver is required to pass around the partial obstacle constituted by the microphone (the body of which is acoustically opaque) in travelling to the ear drum. In existing constructions sufficient space is left around the microphone so that there is no significant acoustic impedance.

The considerations at hand for designing in-ear devices having active noise reduction using feedback control are very different to those present with headphones, or feed-forward architectures. In particular, stability is an issue as the load condition of the device can greatly affect the open loop transfer function (OLTF). This dynamic is the main constraint during the design of the active noise reduction functionality performance of the device. In fact, the larger the dynamic of the OLTF the larger the stability margin of the closed loop system must be in order to ensure the robustness of the active noise reduction functionality.

Further miniaturisation is only exacerbating these issues. For example, commonly used electrodynamic drivers see their source impedance increasing with the inverse of the square of the diaphragm area. Additional measures must therefore be taken to ensure the stability and performance of the system since they become increasingly sensitive to their loads. In addition, moving the electronics required to create a feedback controller, or part thereof, inside the housing would require considerable miniaturisation of the acoustic system to achieve a decrease in overall size of the device and consequently a carefully tuned OLTF would be required to reduce the necessary controller complexity to design a high performance noise cancellation system. The use of acoustic impedances as described in embodiments of the present invention provides a solution for tuning the OLTF for a miniaturised in-ear device incorporating active noise reduction through feedback or hybrid control architectures.

OBJECT

It is an object of the invention to provide improved active noise cancellation performance in an in-ear device or to at least provide the public with a useful alternative to existing devices.

Other objects of the invention may become apparent from the following description, which is given by way of example only.

SUMMARY OF THE INVENTION

In one aspect the invention provides an in-ear device comprising:

- a housing adapted for location in or adjacent to an auditory canal, the housing having an acoustic outlet for location in the auditory canal;
- a driver provided in the housing;
- an acoustic path within the housing extending from the driver to the outlet;
- a microphone provided in the acoustic path between the driver and the outlet, and
- a high acoustic impedance provided in the acoustic path.

In one embodiment the high acoustic impedance is such that the impedance of the device from the driver input to the microphone output over a selected audio frequency range is greater than the impedance of the driver over the selected audio frequency range.

In one embodiment the frequency range comprises the mid-range audio frequencies.

In one embodiment the frequency range is 1 kHz to 2 kHz.

In one embodiment the frequency range is 200 Hz to 2 kHz.

In one embodiment the frequency range is 1 kHz to 2.5 kHz.

In one embodiment the acoustic impedance is provided by a constriction in the acoustic path.

In one embodiment the acoustic impedance is provided at a periphery of the microphone. Preferably the impedance is provided between the periphery of the microphone and a wall of the device.

In another embodiment the acoustic impedance is provided between the microphone and the outlet.

In one embodiment the impedance comprises an acoustic resistance

In one embodiment the impedance is selected to improve stability of the device when used in an active noise reduction feedback or hybrid control architecture.

In one embodiment the impedance is selected to attenuate noise from a source external to the device, also referred to as passive attenuation.

In one embodiment the impedance comprises a plurality of pathways arranged around the periphery of the microphone. Preferably the pathways are parallel with the axis of symmetry of the microphone. Preferably the multiple pathways are disposed in a regular distribution around the circumference of the microphone.

In another aspect the invention provides an in-ear device comprising:

a housing adapted for location in or adjacent to the auditory ear canal, the housing having an acoustic outlet for location in the auditory canal;

a driver provided in the housing;

an acoustic path within the housing extending from the driver to the outlet;

a microphone provided in the acoustic path between the driver and the outlet;

a feedback controller for providing a signal to the driver depending upon a signal received from the microphone in order to cancel noise sensed by the microphone, and;

an acoustic impedance provided in the acoustic path adapted to limit the dynamic of the system and improve stability of the device.

In one embodiment the high acoustic impedance is such that the impedance of the device from the driver input to the microphone output over a selected audio frequency range is greater than the impedance of the driver over the selected audio frequency range.

In one embodiment the frequency range comprises the mid-range audio frequencies.

In another aspect the invention provides a method of improving the stability of an in-ear device having:

a housing adapted for location in or adjacent to the auditory ear canal, the housing having an acoustic outlet for location in the auditory canal;

a driver;

an acoustic path extending from the driver to the outlet;

a microphone provided in the acoustic path between the driver and the outlet; and a feedback controller for providing a signal to the driver depending upon a signal received from the microphone in order to cancel noise sensed by the microphone, the method comprising providing an acoustic impedance in the acoustic path which is sufficient to improve the stability of the device.

In one embodiment the method includes the steps of determining the impedance of the driver over a selected audio frequency range, and selecting the acoustic impedance such that the impedance of the device from the driver input to the microphone output is greater than the impedance of the driver over the selected audio frequency range.

In one embodiment the frequency range comprises the mid-range audio frequencies.

Other aspects of the invention will be apparent from the following description.

DRAWING DESCRIPTION

One or more embodiments of the invention will be described below with reference to the accompanying drawings, in which.

Figure 6:
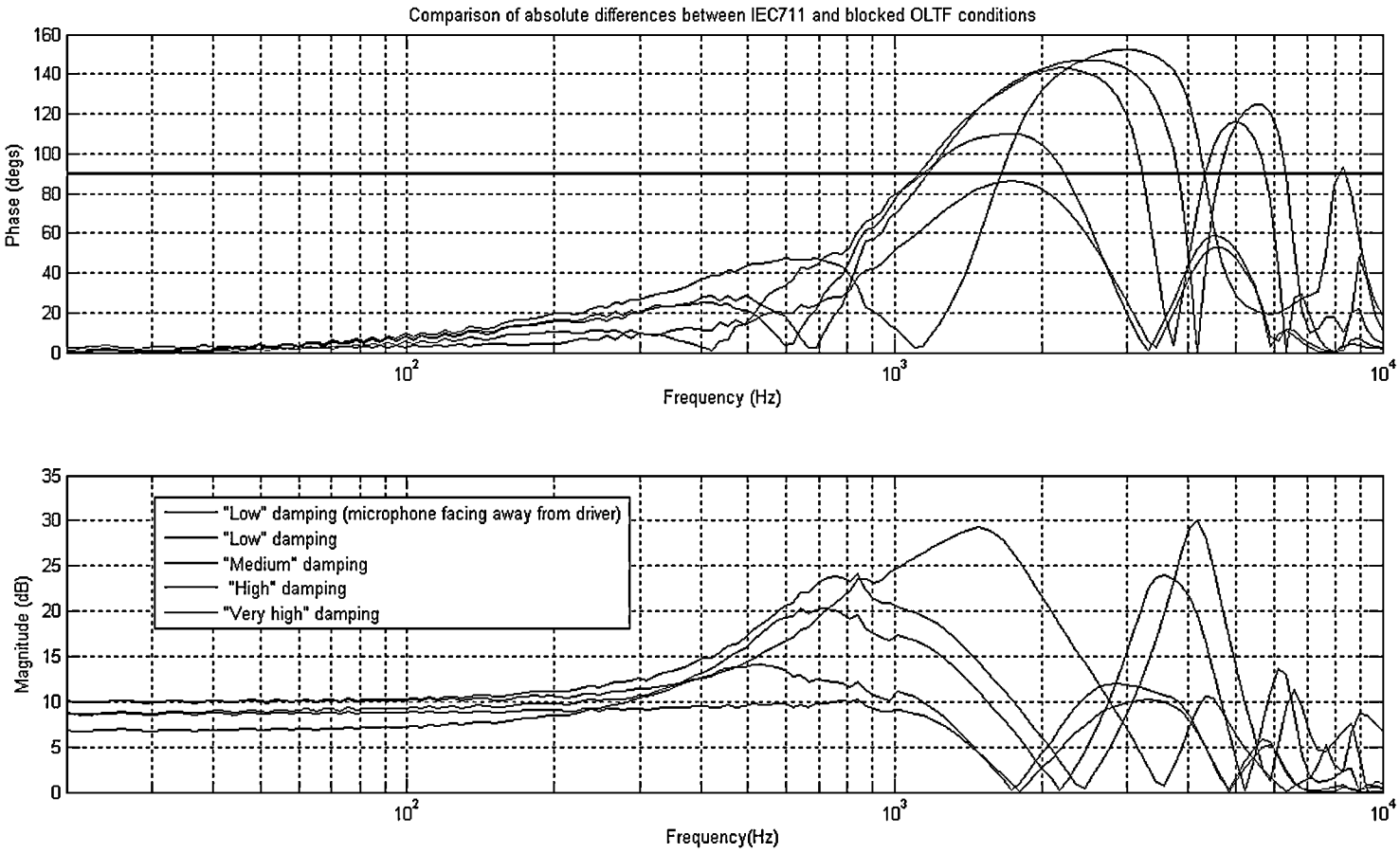

FIG. 6 demonstrates the effects of additional resistance on absolute OLTF differences.

Figure 7:
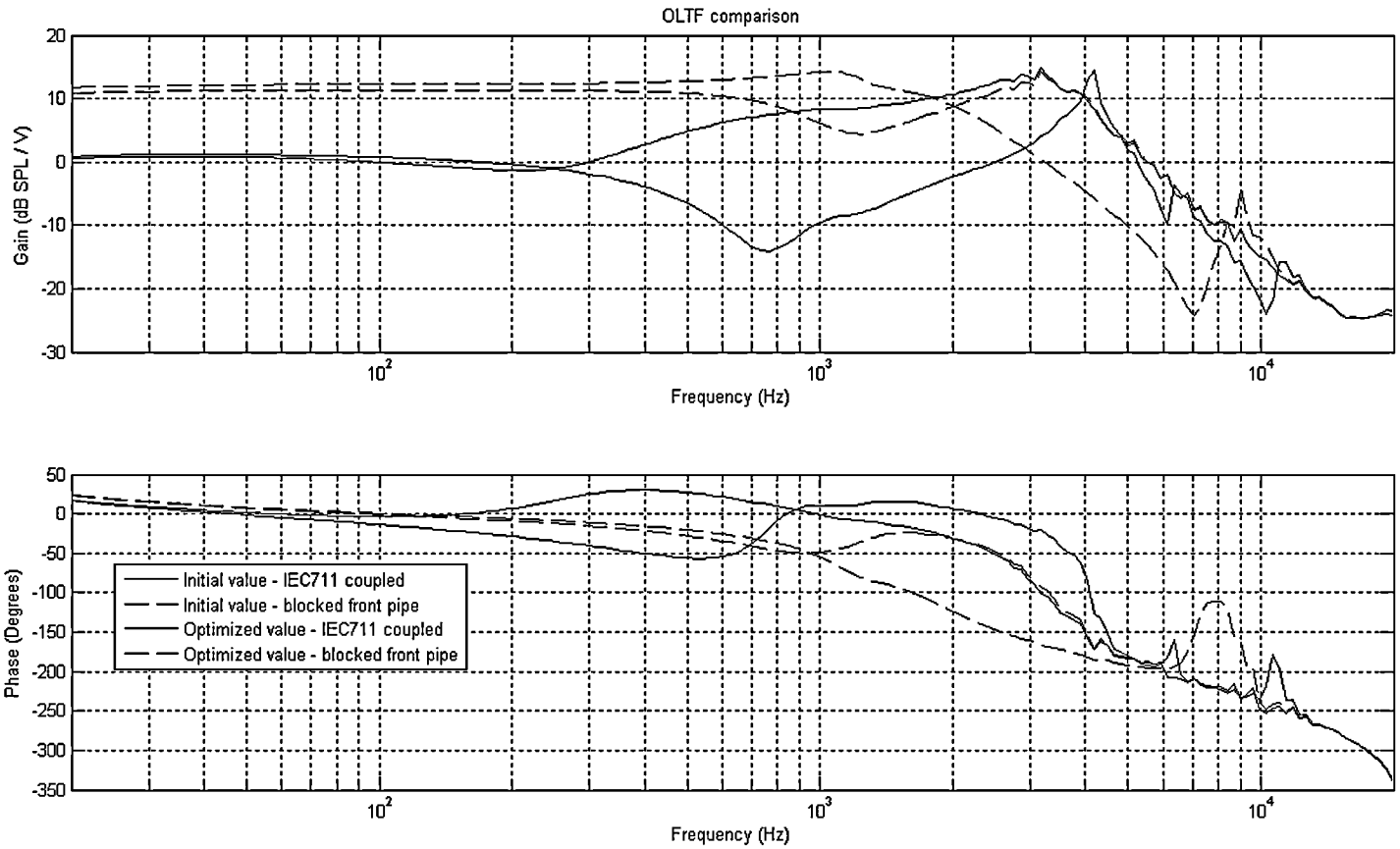
Figure 8:
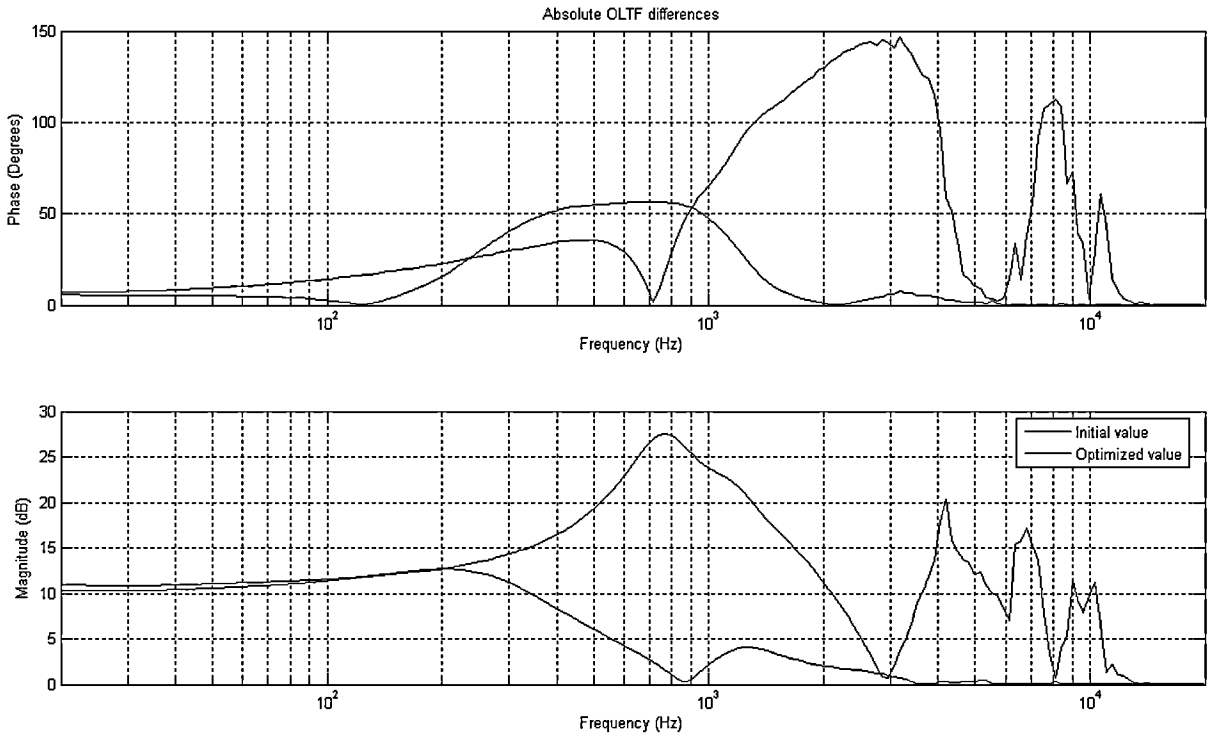

FIGS. 7 and 8 are plots of the OLTF and are OLTF absolute differences (correlated to stability) respectively when measured under two significant loading conditions. Note "optimized value" refers to the desired complex acoustic impedance arrangement described in here.

Figure 9:
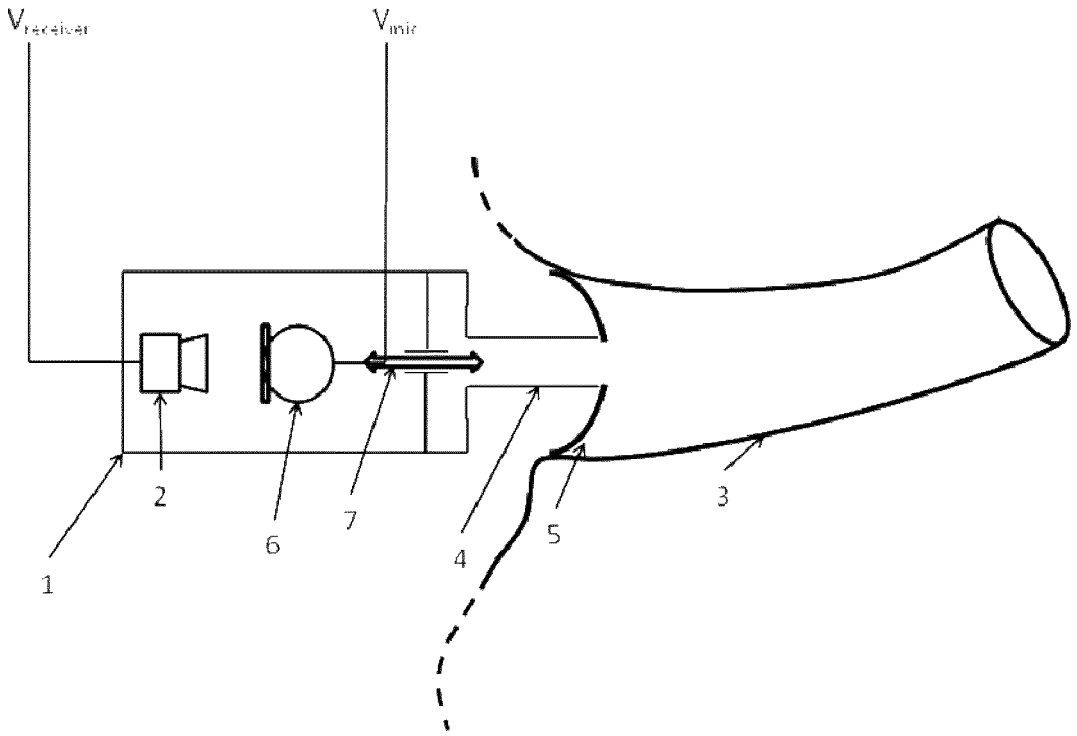

FIG. 9 is a diagrammatic view in cross-section of an in-ear device according to the present invention in use and in conjunction with the human ear canal.

Figure 10:
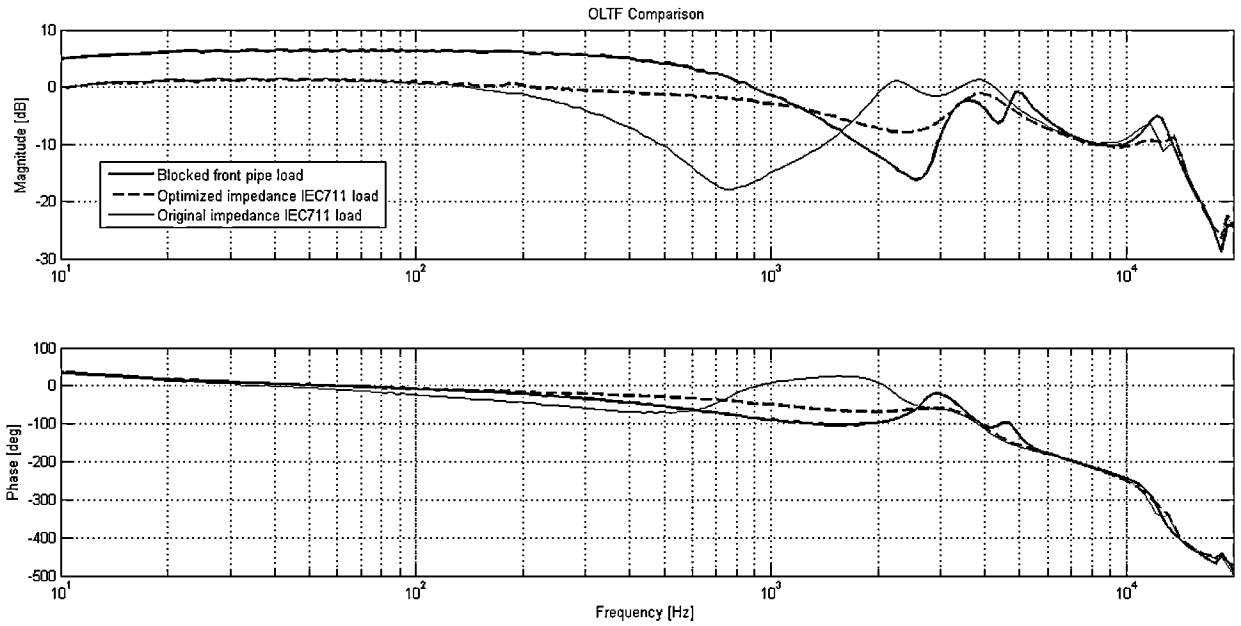
Figure 11:
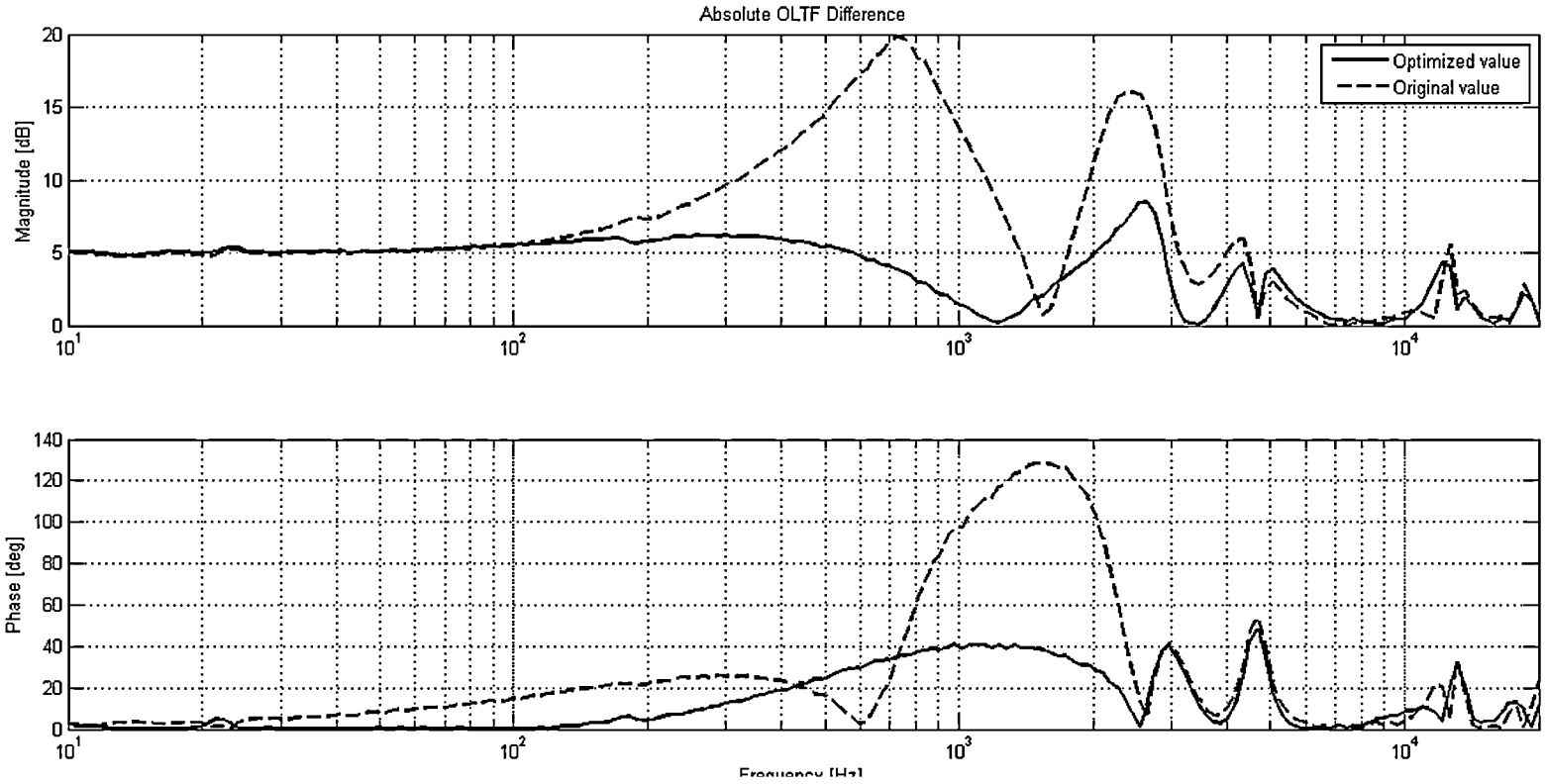

FIGS. 10 and 11 is a plot of the OLTF showing the difference in magnitude when what is essentially an acoustic resistance is is used when coupled to the IEC711 ear simulator and compared to the blocked pipe condition and the OLTF absolute differences (correlated to stability) respectively.

Figure 12:
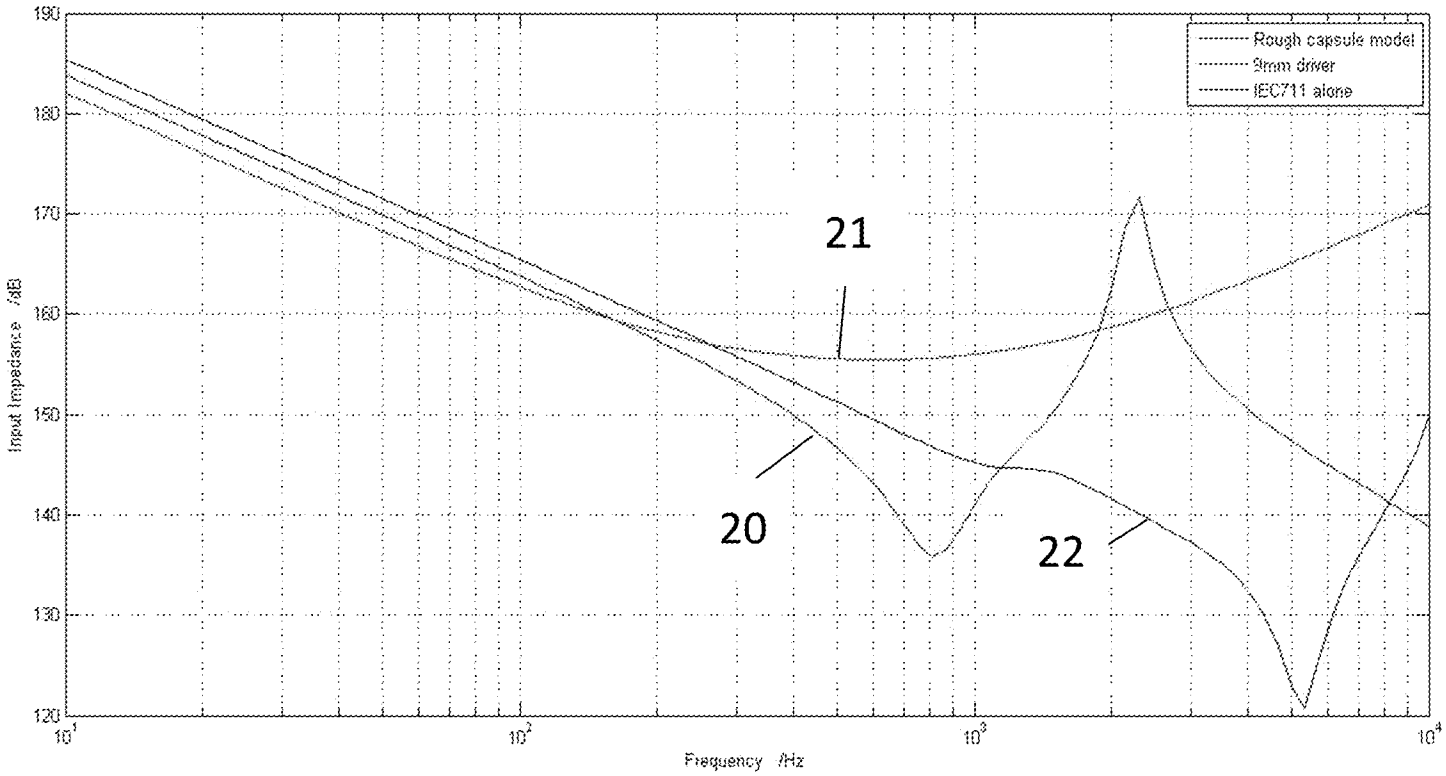

FIG. 12 shows a plot of impedance against frequency for a typical dever for an in-ear device, the IEC711 standard load, and an in-ear device coupled with the IEC711 load.

Figure 13:
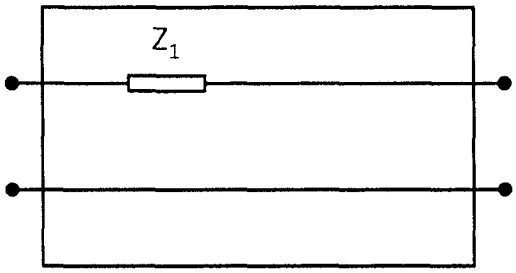

FIG. 13 is a diagrammatic view of an example series impedance.

Figure 14:
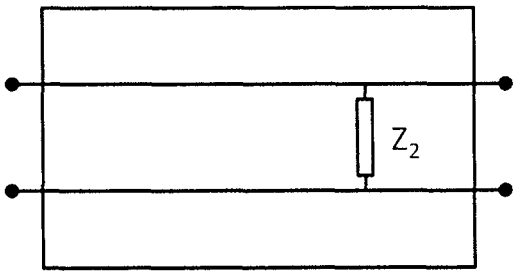

FIG. 14 is a diagrammatic view of an example parallel impedance.

Figure 15:
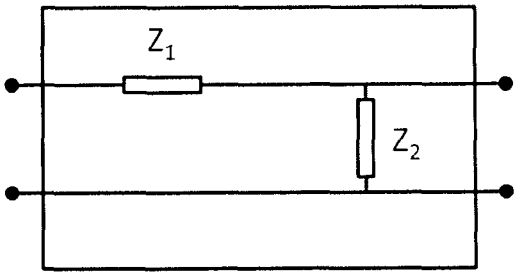

FIG. 15 is a diagrammatic view of an example potential divider, composed of a series impedance and a parallel impedance.

DESCRIPTION OF ONE OR MORE EMBODIMENTS

The present invention relates specifically to the design of the acoustic path or conduit between the driver and the outlet of the device. In some embodiments the invention is realised in the design of the conduits/passageways through which sound is conducted around the microphone. The acoustic impedance of these elements may be designed so as to engineer the electro-acoustic transfer function between the input to the driver and the output from the microphone, which constitutes (a component of) the "open-loop transfer function" (OLTF) of the "system-under-control" or "plant" (to use the terminology of automatic control). This transfer function is a key determinant of system stability and noise cancelling performance. The desired improvement in robustness of the closed loop system is achieved by decreasing the dynamic (i.e. the variation) of the OLTF with regard to vulnerability and sensitivity of the earphone to varying load conditions. Those skilled in the art will understand that a device designed within the ambit of the present invention will exhibit improvements in the active noise reduction functionality performance compared to the same system outside it.

In one embodiment, the present invention teaches the deliberate design of acoustic path(s) around the inboard microphone of an in-ear device in order to introduce desirable properties to the overall system, specifically in terms of robust controllability.

Figure 1:
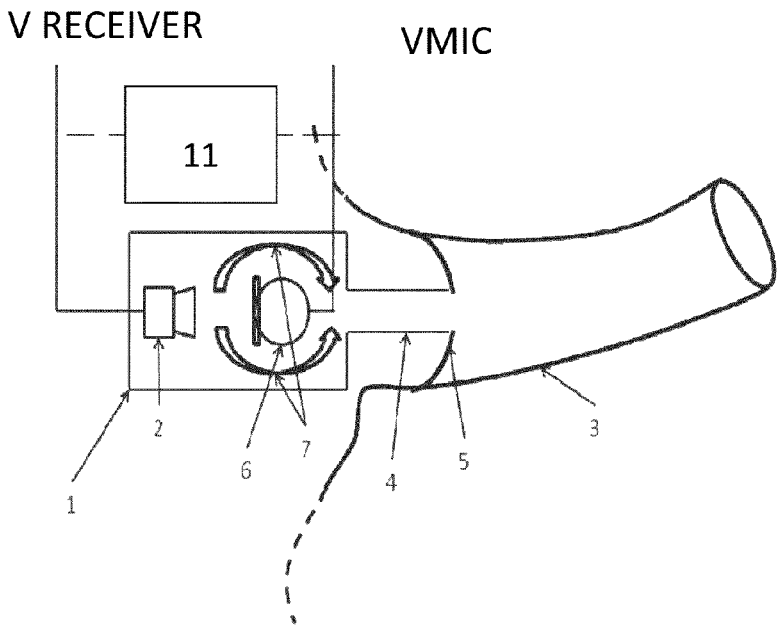
FIG. 1 is a diagrammatic cross-sectional view of an in-ear device in use in conjunction with a human auditory canal.

FIG. 1 shows a first embodiment of an in-ear device (1), comprising a driver (2), mounted in such a way as to be positioned in or near to the opening of the external auditory meatus (3). Sounds generated by the driver are conducted into the meatus through an acoustic network (4, 7, 8, 9) comprising at least some form of waveguide element. This acoustic network is shown with an acoustic resistance in order to further tune the impedance (8). The system may be coupled to the ear in such a way as to form an intended seal by a "tip" or "grommet" component (5).

It has been shown to be beneficial in many noisy environments that the device be capable of actively cancelling, (or at least substantially reducing) sounds that propagate by various paths from external ambient noise fields to the ear. This can usefully be achieved by control strategies in which there is direct observation of the pressures within the (partially) sealed system comprising the device and the remaining volume of the wearer's meatus. For convenience, such observation is provided by a microphone (6) incorporated within the body of the device.

The interaction between the acoustic network constituted by the acoustic output "port" or outlet of the device (4) (which embodies a substantially inductive acoustic impedance) and the volume of air in the meatus (3) (which behaves to first order of approximation as a compliance) is known to exhibit non-trivial acoustic behaviour, introducing a "Helmholtz" resonance. This has been identified as means to optimise the performance of an Active Noise Reduction (ANR) enabled system, by favourably influencing the transfer function between receiver input and microphone output (Vmic/Vreceiver of FIG. 1), as taught in International Patent publication WO 2007/054807 which is included herein by reference. This transfer function, Vmic/Vreceiver, constitutes a component of the "open loop" in an active control application and is directly important to stability and performance. A feedback controller 11 is shown in FIG. 1. Controller 11 may also be provided within the device, for example immediately behind the driver, or adjacent to the microphone.

The present invention addresses the path(s) by which sound is conducted around the microphone (7). These paths express a series acoustic impedance, the optimisation of which constitutes another means for adjusting the overall acoustic (and electro-acoustic) performance of the device, with consequent impact on system stability and performance. The existence of such paths is unique to those applications where an inboard microphone is present (typically those in which it is intended to apply feedback control, hybrid feedback/feed-forward control, or adaptive control).

There are a number of options available for modelling the OLTF of the system. One of the ways to model the OLTF of the system is further illustrated by FIG. 2, in which the transducers (2, 6) are represented as Two Port networks, connecting the electrical signals to the acoustic domain. The acoustic network is comprised of the volume upstream of the microphone (here represented as the shunting impedance 8), the acoustic paths around the microphone (shown here as the series impedance 7), the volume downstream of the microphone (the shunting impedance 9), the outlet port (4) and the acoustic load presented by the ear (10). It is the deliberate manipulation of the acoustics of the pathway impedance around the microphone, represented to first-order of approximation by the impedance (7), in order to introduce desirable features to the transfer function OLTF, Vmic/Vreceiver, which is the subject of this embodiment. Examining the system as a Two Port network allows simulations to be extended beyond the reach of lumped parameter models and allows for more accurate determination of the impedance modifiers necessary to enhance the performance of the closed loop system.

Figure 4B:
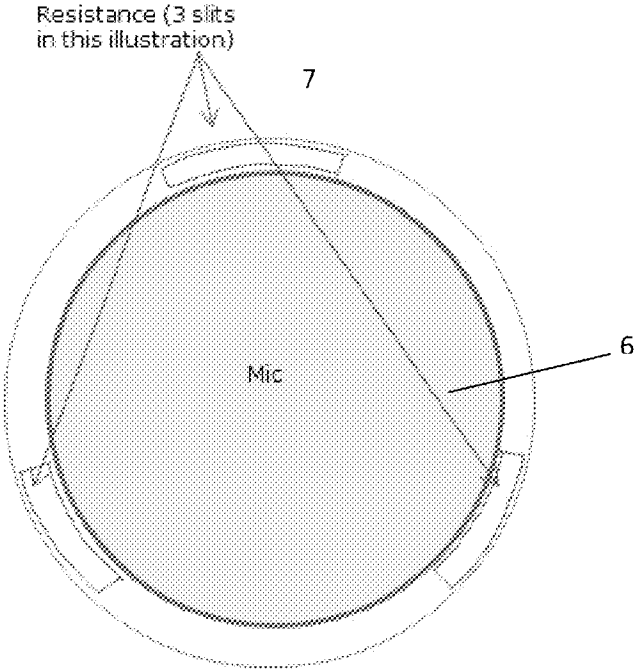
FIG. 4B is an end elevation of the capsule construction shown in FIG. 4A
Figure 4A:
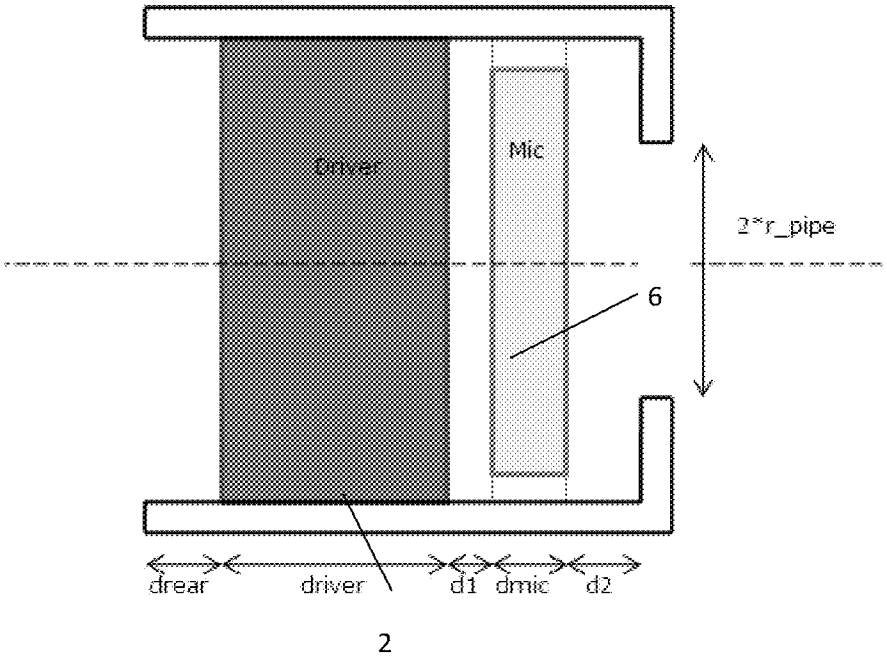
FIG. 4A is a diagrammatic cross-section through a capsule containing a driver and sensing microphone for implementation within an in-ear device. The arrangement is also shown in the end elevation.

These impedance modifiers can be, but are not limited to, path constrictions, expressing both acoustic inductance and resistance. In order to make these impedances sufficiently large to have significance to the overall system dynamics, the paths typically have small cross-sectional area (with carefully defined aspect ratio) and specified length. They have been found to have one embodiment as a series of "slits", regularly disposed around the periphery of the microphone, as discussed further below with reference to FIGS. 4A and 4B.

The slits referred to above can be used in embodiments where the microphone faces toward the driver, see FIG. 1, and in embodiments where the microphone faces away from the driver.

Figure 2:
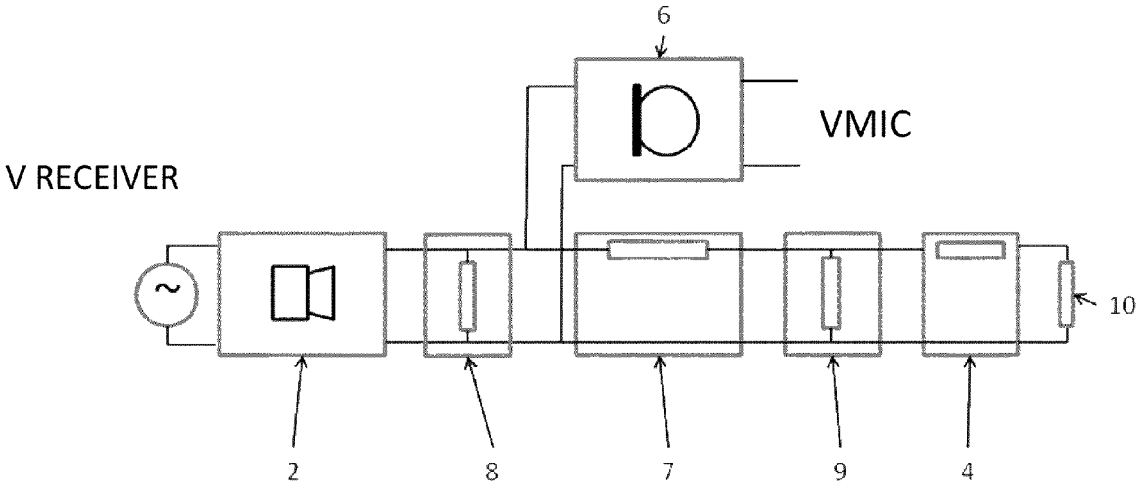
FIG. 2 is a representation of the arrangement of FIG. 1 in which transmitters are represented as two point networks, connecting electrical signals to the acoustic domain.
Figure 3:
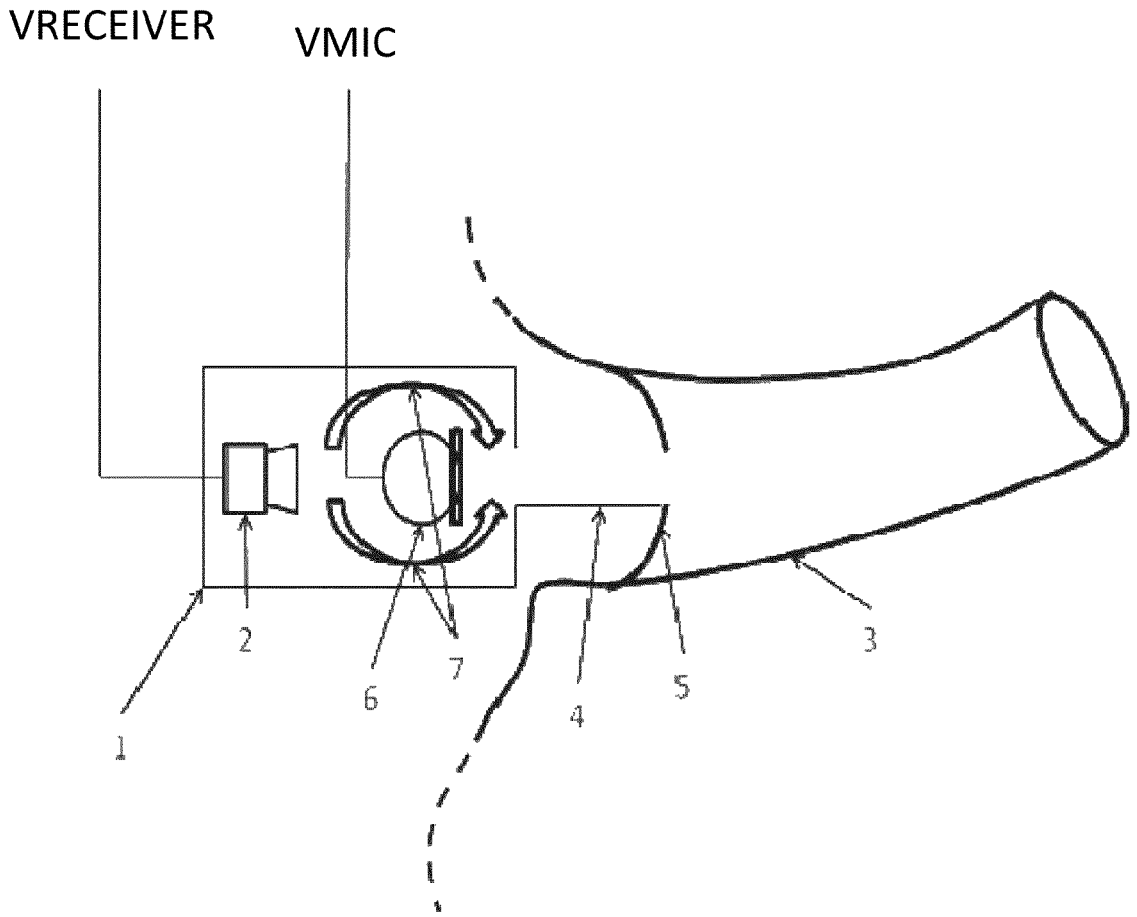
FIG. 3 is a diagrammatic cross-sectional view of an in-ear device in use in conjunction with a human auditory canal.

Although some of the examples taught in this specification relate to the case in which the microphone is intentionally sensitive to pressures "upstream" of the impedance embodied by the acoustic path(s) around the microphone (as depicted in FIGS. 1 & 2), the present invention does teach that it is possible to engineer the passage of sound around the microphone in such a way as to introduce desirable acoustic path impedances in those cases where the microphone is sensitive to pressures downstream of the acoustic path(s) around the microphone as shown in FIG. 3.

An embodiment in which the acoustic path around the microphone is provided in the form of engineered slits is shown in FIG. 4. Referring to that Figure, the three slits (7) are formed between the microphone and an inner housing wall. The microphone in this embodiment faces toward the driver (2), but could alternatively face away from the driver. In the former case the slits can be used for creating a high impedance load within the acoustic path. As exhibited in the Figures, having the microphone facing towards the driver offers the designer the opportunity to create an impedance loading a volume between the driver and the microphone.

Figure 5:
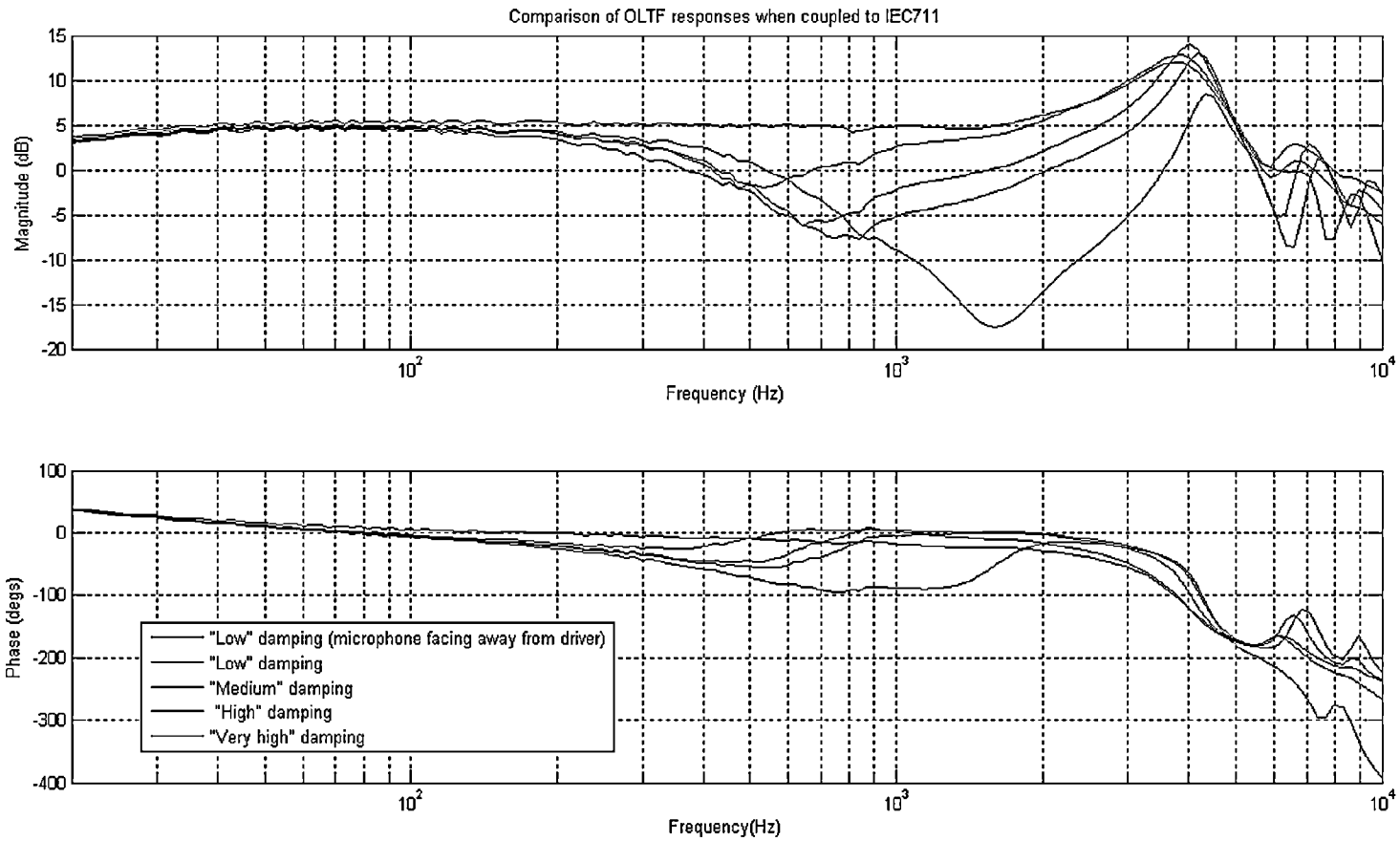
FIG. 5 is a plot of the open loop transfer function of a device such as that shown in FIGS. 4A and 4B showing both magnitude and phase as a function of frequency when the present invention is used as impedance modifier.

The addition of the high impedance in the acoustic path and having the microphone facing towards the driver dampens the Helmholtz resonance, providing a smoother, more regular and larger phase increase, whilst reducing the magnitude and phase differences in the OLTF for a number of key loading conditions, which are typically found during the use of such a product. The former aspect is illustrated in FIG. 5 looking at the OLTF (IEC711 coupled system) for a number of impedances. The latter is illustrated in FIG. 6 by analyzing the magnitude and phase difference for IEC711 and blocked pipe boundary conditions (i.e. a blocked outlet), which are key conditions when assessing stability of the system. IEC711 refers to a standard which is used for modelling the acoustic load behaviour of the human ear.

As can be seen, the addition of the impedance increases the performance of the system and improves the stability, although the optimization of this last point is discussed next. Referring again to FIGS. 4A and 4B, where the front acoustics is considered, it can be seen that a number of physical dimensions are available to the designer. Although best results are found with the microphone facing towards the driver, this is also considered as a design parameter and ideal dimensions could be found for each microphone orientation. These should be varied, including the value of the resistive path, to limit the dynamic of the OLTF of the system and therefore increase the stability of the closed loop system for a number of loading conditions of the device. These can include various:

a) outlet port geometries (dimensions and associated damping/inductance implicitly included in such definition); and
b) outlet port loading conditions, with the two typical cases used being:
   IEC711 or normal wear load condition
   Blocked outlet which aims to simulate non-deal load conditions This is illustrated in FIG. 7 and FIG. 8 for the OLTF and OLTF absolute differences (correlated to stability) respectively, where outlet port dimensions are also part of the optimization process in this particular implementation of the optimization method.

It should be noted that the practical implementation of the "optimized" internal dimensions and transmittance properties must account for:

(i) the effective damping on the frequency response of the system; and (ii) the "noise cancelling decoupling" that can occur between the noise cancelling performance observed at the error microphone of the device and observed at IEC711 microphone in this illustration or experienced by the user in general use.

The embodiments described above teach the use of the inboard microphone as an obstructing object, around which we establish sound-carrying "conduits", the acoustics of which are designed to optimize other features of the closed loop system and enhance its performance. In the embodiments described below these engineered impedances are not necessarily "around" the microphone, but are located at other (or additional) locations in the acoustic path between the driver and the outlet port.

Referring to FIG. 9, an embodiment is shown in which an aperture provided between the microphone and the outlet provides the necessary high impedance. Although the construction is shown as a single aperture, those skilled in the art will appreciate that it may take a variety of forms including a plurality of apertures.

FIGS. 10 and 11 illustrate the system OLTF under a closed outlet load condition and the OLTF in the IEC711 with and without the designed acoustic impedance and OLTF absolute differences (correlated to stability) respectively, where no other parameters where changed.

The addition of engineered acoustic high impedances in the acoustic path modifies the OLTF dynamics. It reduces the difference between the wearing load conditions, as illustrated in this example when coupled with the IEC711 ear simulator, and under closed pipe load condition. The controller can therefore be designed with smaller but still sufficient stability margins to cope with the reduced range of realisable OLTF and/or increase the useable feedback gain with a constant stability margin and/or widen the frequency range covered by the noise cancelation function.

As outlined above, the Two Port representation provides a convenient model to express the system in terms of transmittance and impedances, as approximations of the loads and source impedance of the different parts of the acoustic system can be easily calculated. As an example, in cases where a multiplicity of conduits are employed, their acoustic impedances will (to first order of approximation) act in parallel. It is convenient (though not necessary) that the dimensions (and, therefore, acoustic impedance) of each of a multiplicity of such pathways are equal.

An introduction to the TwoPort network method is shown in Table 1 below. Further information is available in M E Van Valkenberg Network analysis, 3$^{rd}$ ed., Prentice Hall (1974).

Table 1

| Name | Circuit Representation | TwoPort Matrix Representation |
|---|---|---|
| Series Impedance A | See FIG. 13 | $\begin{bmatrix} 1 & z_1 \\ 0 & 1 \end{bmatrix}$ |
| Parallel Impedance B | See FIG. 14 | $\begin{bmatrix} 1 & 0 \\ \frac{1}{z_2} & 1 \end{bmatrix}$ |
| Potential Divider: Combination of the parallel and series C = A × B | See FIG. 15 | $\begin{bmatrix} 1+\frac{z_1}{z_2} & z_1 \\ \frac{1}{z_2} & 1 \end{bmatrix}$ |

A TwoPort representation of an electrodynamic loudspeaker (other types of transducers have other Twoport representations) where the inputs are the usual electrical variables and outputs are the usual acoustical variables is:

$$\left[\frac{V}{i}\right] = \begin{bmatrix} \frac{Z_{EB}S}{Bl} & \frac{Z_m Z_{EB} + (Bl)^2}{Bl} \\ \frac{S}{Bl} & \frac{Z_m}{Bl} \end{bmatrix} \left[\frac{p}{u}\right]$$

In which:

V and i are the electrical variables $Z_{EB}$ is the blocked electrical impedance $Z_m$ is the mechanical impedance p, the pressure, and u, the diaphragm velocity are the acoustical variables All other symbols have their usual meaning as those skilled in the art will recognise Further information can be found in M Colloms & P Darlington, High Performance Loudspeakers, 6$^{th}$ ed., John Wiley, 2005

The source impedance Zsource of the driver can be calculated as:

$$Zsource = \frac{p}{u}$$

The two Port method can be used to characterise acoustic networks. Example of a Two Port of a uniform lossless acoustic waveguide of section S and length L, has the acoustic variables at each end related by a Two Port in which k is the wave number:

$$\begin{bmatrix} p_0 \\ U_0 \end{bmatrix} = \begin{bmatrix} \cos(kL) & \frac{j\rho_0 c}{S}\sin(kL) \\ \frac{jS}{\rho_0 c}\sin(kL) & \cos(kL) \end{bmatrix} \begin{bmatrix} p_1 \\ U_1 \end{bmatrix}$$

The elements of an unknown Two Port can be determined performing some measurements according to Egolf, D. P., and Leonard, R. G. (1977) "Experimental scheme for analyzing the dynamic behavior of electro-acoustic transducers," J. Acoust. Soc. Am. 62, 1013-1023. Also, many acoustic elements and their lumped parameters equivalent circuits are showed in J. Borwick Loudspeaker and headphone handbook, 3rd ed., 2001, 9780240515786, p 588.

The introduction of one or more high impedance pathways within the body of an in-ear device increases the overall series impedance of the device. This has the generally beneficial effect of reducing the transmission of unwanted noise through the body of the device to the ear (i.e. it will increase the passive attenuation of the device). This is particularly important in the case of dynamic receivers, which may require openings to the rear of their diaphragm in order to avoid undesirable high-compliance loading on the diaphragm. Sound from an external ambient noise field can pass through these openings, through the diaphragm and onward to the ear. The introduction of high impedance obstacles in this subsequent path to the ear is seen to afford means to control the level of attenuation provided by this noise transmission path.

The introduction of the engineered acoustic conduits around the microphone increases the acoustic source impedance of the device. Note the small drivers used in these implementations have high source impedance (in the order of 5.6M Rayl compared to typically 415 Rayl for the air and 1.8M rayls for the IEC711) and thus are very sensitive to load variation hence care that must be taken in designing the acoustic conduits. This has known (and, potentially damaging) consequences to aspects of system performance (including sensitivity, leak sensitivity, stability and frequency response). Notwithstanding these consequences, the conduits offer overall benefit in giving the designer more control over the open loop response, Vmic/Vreceiver.

The paths or conduits may take simple form (such as a uniform section pipe) or more complex form (including for example bent pipes, concatenated pipes of changing cross-section, etc). In the case of the simpler, similarly simple models of the acoustic impedance (such as inductances and resistances) will appear as the first-order models of the conduit transfer acoustics. This may permit adequate parameterisation of the path to allow optimisation of aspects of overall system behaviour. More complete modelling of the acoustics of simple conduit forms—or modelling of the acoustics of more complex forms—both will motivate more sophisticated statements of the impedance (such as the generalized solutions that may arise from finite element analysis or similar numerical models). The conduits are then designed such that these generalized impedances confer the desired significant impedance compared to the driver source impedance.

Other forms of acoustic impedance may be used, apart from, or in combination with, the slits or constrictions described above. Thus for example an acoustically resistive mesh may be located at area 7 in the FIGS. 1 and 3 embodiments as an alternative, or addition to, the engineered slits between the periphery of microphone 6 and the internal wall of housing 1. Furthermore, an acoustically resistive mesh may be provided at another location in the acoustic path, for example as an alternative to, or in addition to, the constriction 7 shown in the FIG. 9 embodiment.

Referring now to FIG. 12, the vertical axis represents impedance on a logarithmic scale (dBOhms), and the horizontal axis represents frequency on a logarithmic scale. The variation in impedance with frequency for an in-ear device such as that shown in the FIG. 1 embodiment when coupled to an IEC711 load is shown by locus 20. The variation in impedance with frequency for a 9 mm diameter driver for an in-ear device is shown by locus 21. The variation in impedance with frequency for an IEC711 load is shown by locus 22.

The in-ear device (locus 20) in FIG. 12 does not include an engineered high impedance in the acoustic path between the driver and the outlet. As can be seen, from around 200 Hz to 2 kHz the driver impedance dominates, so the device is much more susceptible to changes in load. We have found that adding an acoustic impedance in the acoustic path of the device which is sufficient to increase the impedance of the device (i.e. the impedance from the driver input to the microphone output to be greater than that of the driver over a required audio frequency range, particularly the mid-range audio frequencies (i.e. those between approximately 200 Hz to 2 kHz) greatly improves stability. The impedance can be designed using the physical apparatus and modelling methodologies described above. In the example shown in FIG. 12, the performance of the in-ear device deteriorates in the frequency range between approximately 200 Hz to 2 kHz. The driver impedance in this range is approximately 56 megohm. As can be seen, the impedance of the device at its lowest point (approximately 800 Hz) is at least a factor of ten less than 56 megohm, so an additional impedance of at least 50 megohm across the 200 Hz to 2 kHz frequency range is required to be incorporated in the device design to ensure that the impedance of the device is greater than that of the driver over the frequency range of interest. In practice this can be achieved using engineered slits such as those described above which can be used to add significantly to the impedance (for example in 10 megohm increments) and other impedance devices such as mesh which can add impedance in smaller increments. The impedance of the mesh can be defines by its permeability which is in the range from 160 to 1500 L/m^2·s (liter per square meter per second). The impedance can be added through other design approaches, for example mechanical housing design.

The use of a high impedance load as described in this document between the error microphone and ear has the benefits that it:

1. Defines a large impedance, which becomes the dominant factor in the series of impedances as described above), and as such:

a. Reduces the sensitivity of the OLTF to loading conditions b. Reduces the sensitivity to the design of the earphone itself around the encapsulated driver and microphone of the product 2. The increase in inductance lowers the Helmholtz resonance (the resonance described in international patent publication WO 2007/054807 "Noise Cancellation Earphone").

3. The specified resistance will ensure that the transmission line between the driver and microphone is loaded by a large resistance at the Helmholtz resonance (i.e. it damps a resonance that is otherwise a core feature of in-ear device acoustics) thus:

a. Improving the open loop transfer function smoothness (decreases dips and peaks difference) thus increase stability across a range of acoustic loads b. Improving the consistency of the gain and phase response & thus increase stability across a range of acoustic loads The specified impedance is therefore 'optimized' by balancing these points and the other design parameters:

the receiving frequency response of the earphone;

the open loop response and—hence, noise cancellation; and internal acoustics of the system which determine how active cancellation at the sensing microphone maps to useful active attenuation at the eardrum.

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the spirit or scope of the appended claims.

The invention claimed is:

1. An in-ear device comprising:

a housing adapted for location in or adjacent to an auditory canal, the housing having an acoustic outlet for location in the auditory canal;

a driver provided in the housing, the driver having a first acoustic impedance;

an acoustic path within the housing extending from the driver to the outlet;

a microphone provided in the acoustic path between the driver and the outlet, a second acoustic impedance provided around the periphery of the microphone and in the acoustic path, the second acoustic impedance greater than the first acoustic impedance, wherein the second acoustic impedance is such that the acoustic impedance of the in-ear device from the driver input to the microphone output over a selected audio frequency range is greater than the first acoustic impedance over the selected audio frequency range; and a third acoustic impedance at the acoustic outlet, the acoustic outlet formed by a tube, the tube having a length longer than its diameter.

2. The device of claim 1 wherein the frequency range is 1 kHz to 2 kHz.

3. The device of claim 1 wherein the frequency range is 200 Hz to 2 kHz.

4. The device of claim 1 wherein the frequency range is 1 kHz to 2.5 kHz.

5. The device of claim 1 wherein the second acoustic impedance is provided by a constriction in the acoustic path.

6. The device of claim 1 wherein the second acoustic impedance is provided between the periphery of the microphone and a wall of the device.

7. The device of claim 1 wherein the second acoustic impedance comprises a plurality of pathways arranged around the periphery of the microphone.

8. The device of claim 7 wherein the plurality of pathways are parallel with the axis of symmetry of the microphone.

9. The device of claim 7 wherein the plurality of pathways are disposed in a regular distribution around the circumference of the microphone.

10. The device of claim 1 wherein the second acoustic resistance comprises a mesh.

11. The device of claim 1 wherein the second acoustic impedance lowers or damps a Helmholtz resonance created in the in-ear device by an outlet pipe and an in ear volume.

12. The device of claim 1, wherein the microphone has a front and a back, and the front of the microphone faces towards the driver.

13. An in-ear device comprising:

a housing adapted for location in or adjacent to an auditory ear canal, the housing having an acoustic outlet for location in the auditory ear canal;

a driver provided in the housing, the driver having a first acoustic impedance;

an acoustic path within the housing extending from the driver to the outlet;

a microphone provided in the acoustic path between the driver and the outlet;

a feedback controller for providing a signal to the driver depending upon a signal received from the microphone in order to cancel noise sensed by the microphone, and;

a plurality of acoustic conduits around the periphery of the microphone, the plurality of acoustic conduits providing a second acoustic impedance adapted to improve the stability of the device, the second acoustic impedance greater than the first acoustic impedance; and wherein the second acoustic impedance is such that the acoustic impedance of the in-ear device from the driver input to the microphone output over a selected audio frequency range is greater than the first acoustic impedance over the selected audio frequency range; and a third acoustic impedance at the acoustic outlet, the acoustic outlet formed by a tube, the tube having a length longer that its diameter.

14. The device of claim 13 wherein the feedback controller is provided within the housing.

15. The device of claim 13 wherein the frequency range comprises the mid-range audio frequencies.

16. An in-ear device as claimed in claim 13 wherein the impedance lowers or damps a Helmholtz resonance in the in-ear device.

17. A method of controlling the stability of an in-ear device having:

a housing adapted for location in or adjacent to an auditory ear canal, the housing having an acoustic outlet for location in the auditory ear canal;

a driver having a first acoustic impedance;

an acoustic path extending from the driver to the outlet;

a microphone provided in the acoustic path between the driver and the outlet; and a feedback controller for providing a signal to the driver depending upon a signal received from the microphone in order to cancel noise sensed by the microphone, the method comprising the operations of:

providing an acoustic impedance around the periphery of the microphone which is sufficient to improve the stability of the device;

determining the impedance of the driver over a selected audio frequency range; and selecting the acoustic impedance around the periphery of the microphone such that the acoustic impedance of the in-ear device from the driver input to the microphone output is greater than the first acoustic impedance over the selected audio frequency range.

18. A method as claimed in claim 17 wherein the frequency range comprises the mid-range audio frequencies.

19. A method of improving a stability of an in-ear device as claimed in claim 17 including the step of selecting the acoustic impedance such that a Helmholtz resonance in the in-ear device is lowered or dampened.

* * * * *